United States Patent [19]

Marleau

[11] 4,399,723

[45] Aug. 23, 1983

[54] COMPACT COMBINATION TOOL SET

[76] Inventor: Gilles Marleau, 85 Brady St., Hull, Quebec, Canada, J8Y 5L6

[21] Appl. No.: 190,714

[22] Filed: Sep. 25, 1980

Related U.S. Application Data

[63] Continuation-in-part of Ser. No. 56,725, Jul. 11, 1979, abandoned.

[51] Int. Cl.[3] ..... B25G 1/08

[52] U.S. Cl. ..... 81/437; 81/438; 81/439; 145/61 J; 145/62

[58] Field of Search ..... 81/437, 436, 438, 439; 145/61 J, 62, 64

[56] References Cited

U.S. PATENT DOCUMENTS

| | | | |
|---|---|---|---|
| 368,795 | 8/1887 | Trotter | 145/62 |
| 1,250,328 | 12/1917 | Langford | 81/439 |
| 1,541,078 | 6/1925 | Sudweeks | 145/62 |
| 2,022,775 | 12/1935 | Holland-Letz | 145/62 |
| 2,717,442 | 9/1955 | Smith | 145/62 |
| 2,758,494 | 8/1956 | Jenkins | 81/438 |
| 3,561,510 | 2/1971 | Johnson | 81/436 |

FOREIGN PATENT DOCUMENTS

| | | | |
|---|---|---|---|
| 614017 | 5/1935 | Fed. Rep. of Germany | 145/62 |
| 511849 | 9/1920 | France | 145/62 |
| 470775 | 4/1952 | Italy | 145/62 |
| 233425 | 10/1944 | Switzerland | 81/439 |
| 403769 | 1/1934 | United Kingdom | 145/62 |

*Primary Examiner*—James L. Jones, Jr.
*Assistant Examiner*—J. T. Zatarga
*Attorney, Agent, or Firm*—Murray Schaffer

[57] ABSTRACT

A compact combination tool set providing a complete set of tools such as screw drivers, wrenches, knives, utensils or combinations of such devices is provided. The set comprises a plurality of inter-fitting tool segments, each tool segment having a tool or connecting shank projecting from one end thereof and a recess at the other end thereof adapted to receive a tool or shank projecting from one end of a second tool segment, said recesses and said projecting tools including portions which are noncircular in cross-section and which are adapted to be telescopically and frictionally interengaged so as to prevent relative rotation thereof, whereby a plurality of tool segments may be selectively inter-fitted for compact storage, and selectively separated for use. The tool segments in one embodiment have shanks which are of the same length and cross-section whereby tool segments of different sizes are selectively interengageable with each other or with an associated handle means.

4 Claims, 14 Drawing Figures

COMPACT COMBINATION TOOL SET

RELATED APPLICATION

This is a continuation-in-part of U.S. Appl. Ser. No. 56,725 filed July 11, 1979, now abandoned.

This invention is directed to compact combination tool sets, whereby a plurality of sets of tools such as socket wrenches, screw drivers, knives, utensils or other devices are provided in inter-fitting relationship.

The invention also provides inter-fitting sets of a variety of combinations of tools, such as socket wrenches, screw drivers, knives, drawing instruments or the like are combined in an interlocking unit.

An object of the invention is to provide a compact assortment of tools in a pre-selected variety of sizes and shapes, which inter-fit and thus may be transported or stored as a compact unit, but are readily separated when a specific tool is required.

A principal object is to provide a compact combination tool set comprising: a plurality of inter-fitting tool segments; each tool segment having a tool projecting from one end thereof and a recess at the other end thereof adapted to receive a tool projecting from one end of a second tool segment; said recesses and said projecting tools including portions which are non-circular in cross-section and which are adapted to be telescopically and frictionally inter-engaged so as to prevent relative rotation thereof; whereby a plurality of tool segments may be selectively inter-fitted for compact storage, and selectively separated for use.

These and other objects of the invention will become apparent with reference to the accompanying drawings in which.

Figure 5:
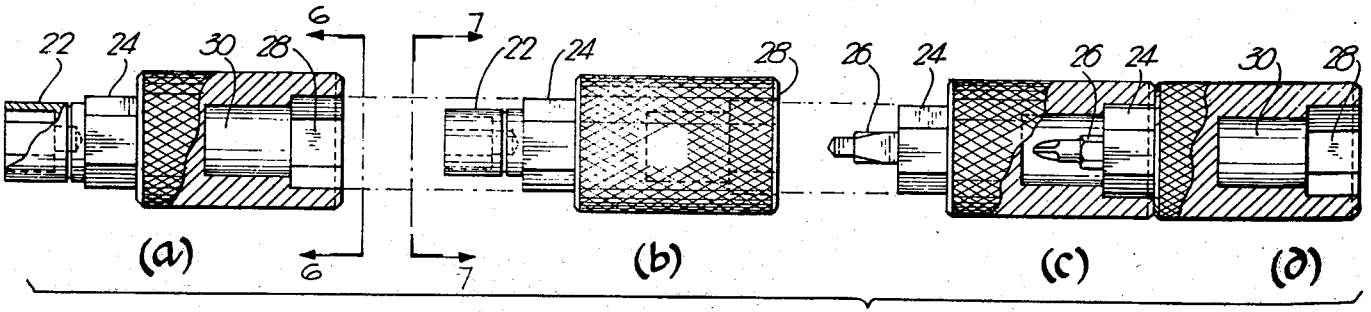
FIG. 5 is a view similar to FIG. 1, showing an alternative embodiment.
Figure 6:
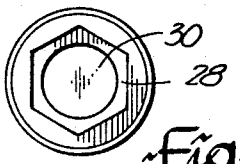
Figure 7:
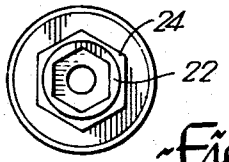
Figure 8:
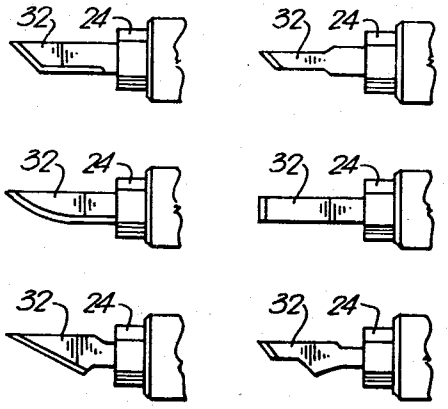
Figure 9:
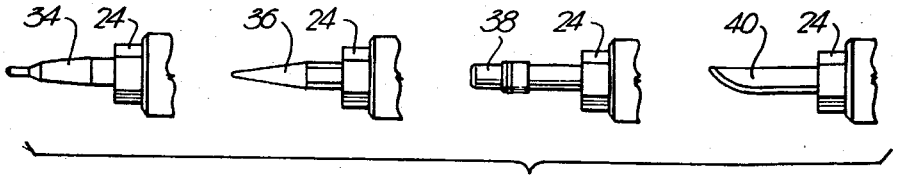
Figure 14:
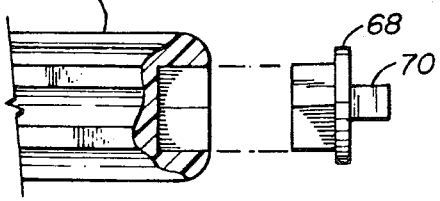

FIGS. 6 and 7 are plan views taken along lines 6—6 and 7—7 of FIG. 5, respectively;

FIGS. 8 and 9 each illustrate examples of additional tool sets for use in the invention;

FIGS. 10, 11, 12 and 13 are exploded views, partly in section, of additional embodiments of the tool set; and FIG. 14 is a sectional view of a tool handle end adapted to cooperate with a ratchet lever or the like not illustrated.

Detailed reference will now be made to the drawings wherein like reference numerals will identify like parts.

Figure 1:
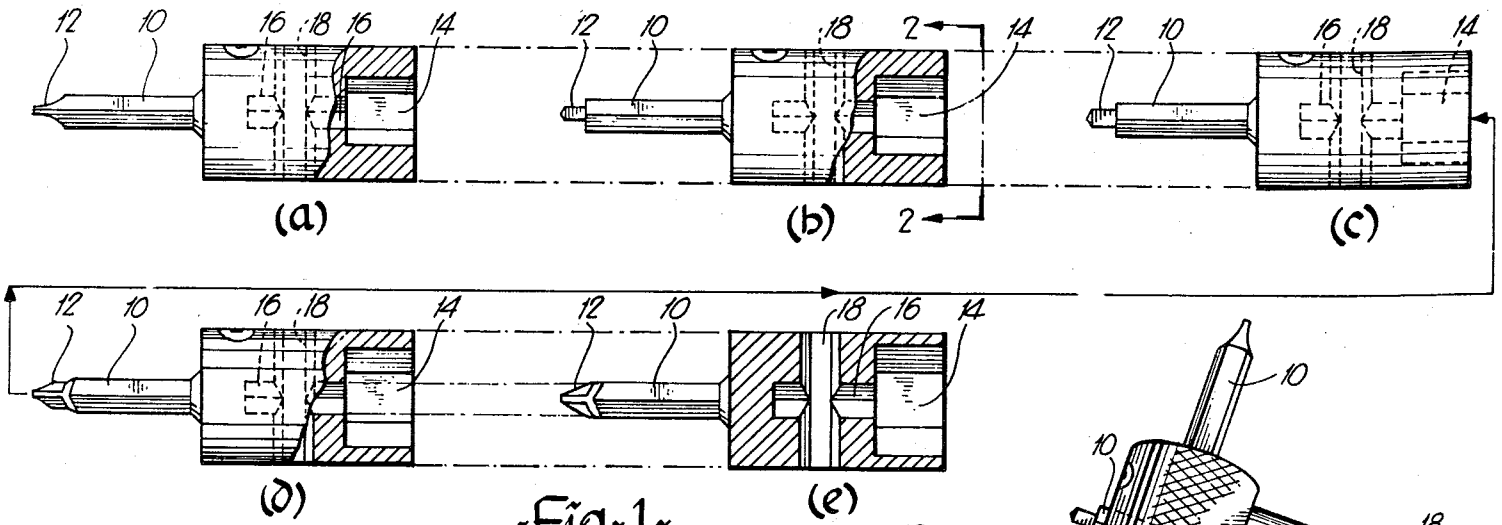
FIG. 1 is an exploded view, partly in section, of one embodiment of an inter-fitting tool set according to the invention.
Figure 2:
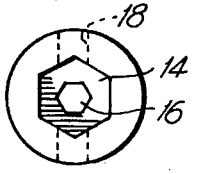
FIG. 2 is a plan view taken along line 2—2 of FIG. 1.

Referring to FIG. 1 (a), (b), (c), (d), and (e), and FIG. 2, a segmented tool is illustrated, having a variety of screw driver blades projecting from one end of each segment, and a plurality of wrench sockets indented at the opposite end thereof. Each screw driver blade comprises a shank 10 and a head 12, and as will be evident heads 12 include a variety of standard flat, Philips, and Robertson heads. Each screw driver shank 10 is hexagonal in cross-section, although as will become evident hereinafter alternative geometrical cross-section configurations may be selected for shanks 10.

Wrench sockets 14 are provided in the end of tool segments (a) through (e), opposite the ends from which screw drivers 10 project, are also in pre-selected sizes. Projecting centrally longitudinally into the interior of tool segments (a) through (e) is an hexagonal bore 16 centrally from the interior of sockets 14, bores 16 being adapted to receive a screw driver shank 10, and frictionally to retain a screw driver shank 10 therein.

Each of tool segments (a) through (e) has a central, transverse, hexagonal bore 18 extending therethrough at right angles to internal bore 16 with bores 16 and 18 intersecting near the center of tool segments (a) through (e).

Figure 3:
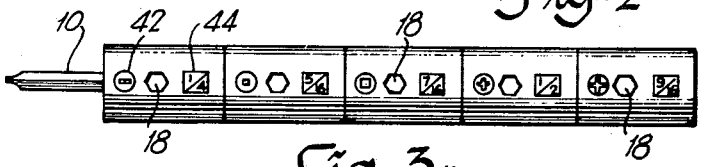
FIG. 3 is a plan view of the tool illustrated in FIG. 1, an inter-fitting relationship.

As seen in FIG. 3 the tool segments of FIG. 1 are illustrated in inter-fitting relationship, with exposed screw driver 10 being in position for use. It will be appreciated that when screw driver shanks 10 are received within internal bores 16 of each of the tool segments, that the hexagonal configuration of shanks 10 and bores 16 will cooperate to prevent relative rotation of adjacent tool segments. Thus, in FIG. 3, an operative screw driver is illustrated.

Figure 4:
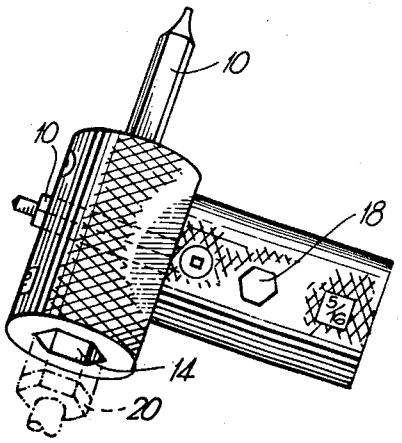
FIG. 4 is a perspective view of tools 1 (a) and 1 (b) as combined when in use.

Referring now to FIG. 4, the screw driver shank 10 of a tool segment has been engaged within the transverse bore 18 of a second tool segment, and that wrench socket 14 of the second tool segment may engage a bolt head or the like 20, and that when socket 14 is in engagement with bolt 20 rotational leverage is manually available through the handle created by the first tool segment projecting therefrom.

When the combination tool according to the invention is being used as a socket wrench it will be appreciated that the cooperating tool segment employed as a turning handle need not engage the tool segment which itself engages a nut or bolt, but any of the inter-fitted tool segments remote therefrom may be engaged, through bore 18, as is most convenient, in order to provide length to the tool. Similarly, the length of the handle may be extended by inter-fitting additional segments thereto.

Referring now to FIGS. 5, 6 and 7, an alternative embodiment of the tool according to FIGS. 1 through 4 is illustrated.

Referring to FIG. 5, segments (a) and (b) are provided with socket wrenches 22 projecting from one end thereof, sockets 22 projecting outwardly from and being integral with hexagonal portions projecting integrally from the tool segments, with both the sockets and the haxagonal portions being in longitudinal alignment. Similarly, in tool segments (c) and (d) screw drivers 26 are shown projecting from corresponding hexagonal tool segment projections. Projections 24 are adapted to be frictionally engaged within hexagonal recesses 28 provided in the end of each tool segment opposite the tool itself. Each tool segment is also provided with an interior chamber 30 adapted to receive either a socket 22 or a screw driver 26, or any other selected tool. Hexagonal projections 24 are provided to cooperate with hexagonal recesses 28, to prevent relative rotation of tool segments during use. The embodiment of FIGS. 5, 6 and 7 has the disadvantage that each tool segment is provided with a tool at only one end thereof, as opposed to the advantage of the embodiment of FIGS. 1 through 4, where each tool segment is provided with two tools, one at each end thereof, as described, however, this embodiment has the advantage that tools of widely varying shapes and sizes may be conveniently inter-fitted together in any desired combination.

Referring again to FIG. 5, it should be noted that a spring loaded ball bearing may be implanted in either projections 24 or in the walls of recesses 28 to provide additional security against separation movement during use. In addition spring loaded balls may be used with projections 24 and recesses 28 when both are circular in cross-section.

Illustrated in FIGS. 8 and 9 are examples of additional sets of tools which may be provided with the embodiments of either FIGS. 1 through 4 or FIGS. 5 through 9. In FIG. 8 a set of cutting blades 32 of selected configuration are provided, while in FIG. 9 tools provided are a pen 34, pencil 36, eraser 38, and knife 40. It will be evident to those skilled in the art that other sets of tools, or combinations of various types of tools may also find utility with the invention.

For example, the following additional tools will find utility with the invention disclosed herein, either as an individual set, or as portions of a combination tool set:

- Set of Allen wrenches (hex keys)
- Screw starter kit
- Hand tap set to cut threads
- Hand file set
- Hand brush set
- Hand drill set
- Hand wrench set
- Hand wood-carving knives set
- Eating utensils sets: spoon, fork, knife
- Personal care set: toothbrush, nail file, nail cutter
- Bar or picnic set: bottle opener, can opener, corkscrew opener
- Marking stamps or printing stamps for marking numerals or letters, or other desired marks such as "OK", "Paid", "File", or the like.

It will be appreciated that tools embodying the above alternatives will vary, as necessary, in their physical dimensions.

Referring again to FIG. 3, it will be noted that each tool segment is provided with indicia to indicate the tools associated with each segment. Thus, a flat screw driver blade is illustrated at 42, and a ¼" socket wrench is illustrated at 44, for the convenience of the user at the time a tool is selected for use. Corresponding indicia may be provided to identify the other tools which are provided, or metric sizing where applicable.

Referring to FIGS. 4 and 5 it will be noted that the exterior surface of the tool segments may be provided with knurling, to prevent slippage during use. While each tool segment illustrated herein is circular in cross-section it will also be evident that any alternative geometric configuration may be selected, just as any desired alternatives to the hexagonal configuration of the screw driver shank 10, as disclosed, may be selected to cooperate with bores 16 and 18 of the tool segments, provided the cross-sectional shape of the shanks and bores cooperate to prevent relative rotation when inter-engaged. It will be appreciated, however, that in some applications it is not essential that this relationship exist, as, for example, with a set of cutlery or the like.

Figure 10:
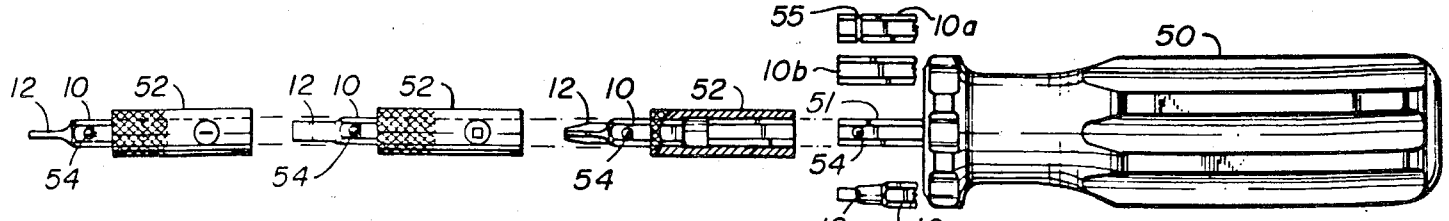
Figure 11:
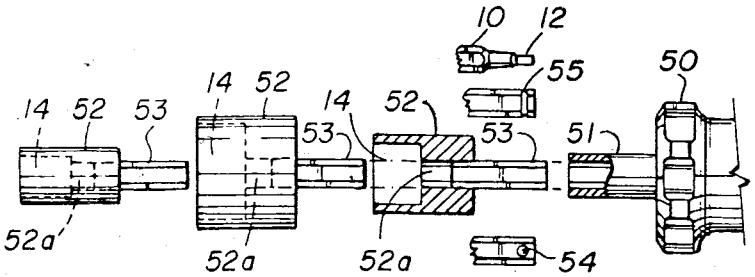
Figure 12:
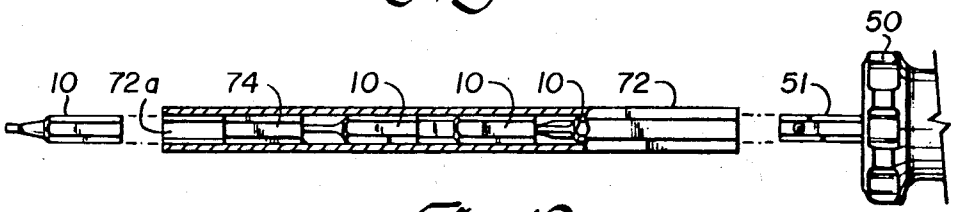

In the embodiments of FIGS. 10 through 13 a handle 50 is provided having a tool engaging shank 51, and is adapted to engage a tool segment, in the case of FIGS. 10 and 12 being screw driver segments comprising shanks 10 having heads 12 of any desired configuration, and body portions 52. As seen in FIG. 10 shanks 10 are provided with a projecting spring-loaded retainer bearing 54, which is selectively removably engageable within body 52 of a screw driver segment 52. Alternatives to the snap ball 54 are also illustrated in FIG. 10, and comprise shanks illustrated in section adjacent handle 50, shank numbered **10*a* being provided with an indented ring 55 adapted for snap engagement within a projection within body 52 of cooperating tool segments, shank 10*b* being magnetic, and shank 10*c* itself including a screw driver head 12**, also adapted for engagement within an adjacent tool segment.

As seen in FIG. 11 wrench sockets 14 are provided in tool segment 52, each segment having a projecting shank 53 adapted for selective inter-locking within a recess **52*a* provided inside each of tools segments 52. In this embodiment the tool segments 52 are magnetized in order to achieve removable inter-locking engagement therebetween. As an alternative to magnetic inter-lock, an indented ring 55, or spring-loaded locking ball 54 or a simple friction fit may be employed. Additionally, a screw driver shank 10 having head 12 may be provided with socket 14**, so that the tool segment comprises a combination wrench socket and screw driver.

In the embodiment of FIG. 12 handle 50 is provided with a shank 51, as in the embodiments described above, and any of the engagement means already described may be employed with shank 51. In this embodiment, however, a storage tube 72, illustrated partly in section, is adapted to be engaged at one end on shank 51 of handle 50, and also to contain a plurality of tool segments 10, which are removable from tube 72, at the end adapted for engagement with handle shank 51. Tube 72 also serves as an elongate shank when in association with handle 50. The end of tube 72 remote from handle 50 is provided with an interior permanent magnet 74, whereby a tool segment may be inserted in tube 72 at end **72*a*, and retained therein under the urging of magnet 74. Tube 72 may be square, hexagonal, or octagonal, as desired, on its interior, and/or on its exterior. Thus, a tool segment such as a screw driver bit may be selected by the user from within tube 72, and inserted into end 72*a* thereof, for use with handle 50, remaining tool segments being safely stored within tube 72** while the tool is in use.

Figure 13:
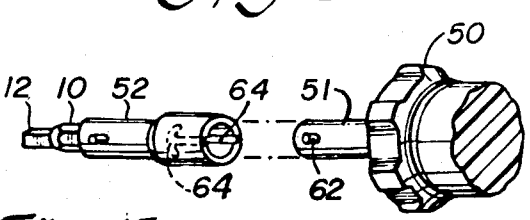

In the embodiment of FIG. 13 handle 50 is provided with a shank 51 having a diametric pin 62 projecting therefrom, for engagement within internal grooves 64 provided within tool segment 52, for inter-locking engagement therewith.

Referring to FIG. 14 handle 50 is provided with a removable cap 68 having a projection 70 on the outer end thereof, projection 70 being adapted for engagement, for example, with a ratchet lever or the like, not illustrated, to provide leverage as necessary when the tool is used in heavy-duty applications as with wrench sockets.

It will be appreciated that in any set of tools, screw drivers, wrench sockets or the like, that the projecting shanks will in each instance be of the same length, and of the same cross-sectional dimension, so that tools may be inter-coupled in any combination, either when being stored, or when being used, or both. For example, wrench sockets may be selected for the size needed for a specific job, and combined with other tools required for the same job, leaving the unneeded tool segments elsewhere, (but in inter-locking engagement), so as to minimize the possibility of loss of a tool segment, while at the same time minimizing the quantity of tool segments which a worker is required to carry to a specific job.

It will also be evident to those skilled in the art that the tool segments disclosed herein may be engaged by means of threaded shanks, and internally threaded tool segments, particularly when the tool segments are other than tools used for rotating screws, nuts or the like, such as knives, files, writing instruments, eating utensils, and the other tools and device referred to hereinbefore.

The embodiments of the invention in which an exclusive property or privilege is claimed are defined as follows:

1. A compact combination tool set comprising:

a plurality of inter-fitting tool segments;

each tool segment having a tool projecting from one end thereof and a recess at the other end thereof adapted to receive a tool projecting from one end of a second tool segment;

said recesses and said projecting tools including portions which are non-circular in cross-section and which are adapted to be telescopically and frictionally inter-engaged so as to prevent relative rotation thereof;

each of said projecting tools being of the same length and cross-section and each of said recesses being of a length sufficient to fully receive said tools therein;

whereby a plurality of tool segments may be selectively inter-fitted for compact storage, and selectively separated for use in any one of said recesses.

2. A compact combination tool set according to claim 1, each of said tool segment recesses being configured as a wrench socket at the other ends thereof.

3. A compact combination tool set comprising:

a plurality of inter-fitting tool segments;

each tool segment having a tool projecting from one end thereof and a recess at the other end thereof adapted to receive a tool projecting from one end of a second tool segment;

said recess being configured as a wrench socket at the outer end thereof;

said recesses and said projecting tools including portions which are non-circular in cross-section and which are adapted to be telescopically and frictionally inter-engaged so as to prevent relative rotation thereof.

each of said projecting tools being of the same length and cross-section and each of said recesses being of a length sufficient to fully receive said tools therein;

whereby a plurality of tool segments may be selectively inter-fitted for compact storage, and one tool segment selectively separated therefrom, and inter-engaged with said other tool segments at one end of said plurality of inter-fitted tool segments, for use thereof;

each of said tool segments having a transverse bore therein adapted to receive a shank of a tool projecting from any one of a second tool segment whereby said second tool segment provides a handle for the application of torque thereto.

4. A compact combination tool set according to claims 1 or 3, the exterior surface of each tool segment being roughened to reduce slippage.

* * * * *